US005101906A

United States Patent [19]

Carlin et al.

[11] Patent Number: 5,101,906

[45] Date of Patent: Apr. 7, 1992

[54] HORIZONTAL DRILLING OR COMPLETION METHOD

[75] Inventors: Frank J. Carlin; Thomas B. Smith, both of Houston, Tex.

[73] Assignee: Grant TFW, Houston, Tex.

[21] Appl. No.: 610,301

[22] Filed: Nov. 5, 1990

Related U.S. Application Data

[63] Continuation-in-part of Ser. No. 407,950, Sep. 15, 1989, abandoned.

[51] Int. Cl.[5] ..... E21B 17/043; E21B 19/16; F16L 15/00

[52] U.S. Cl. ..... 166/380; 166/50; 166/384; 285/89; 285/92

[58] Field of Search ..... 166/380, 384, 50, 242; 285/89, 92; 403/320, 343; 175/320, 61, 62

[56] References Cited

U.S. PATENT DOCUMENTS 2,198,016 4/1940 Rogers et al. ..... 175/320 X
3,475,040 10/1969 Graff ..... 285/89
3,762,745 10/1973 Cunningham ..... 285/92
4,949,791 8/1990 Hopmann, et al. ..... 166/380

*Primary Examiner*—Stephen J. Novosad
*Attorney, Agent, or Firm*—Jackson & Walker

[57] ABSTRACT

A method is provided for maintaining threaded joints of a tool string to prevent jamming of the threads by rotation of a tool string required during movement of the tool string through a generally horizontal production portion and a curved bore portion of the well. Each thread joint is formed by use of an externally threaded pin and box configuration with the external diameter of the box substantially exceeding the external diameter of the pin. The cooperating threads are configured so that limited relative axial movement produces locking of cooperating threads against realtive rotation after full engagement. Relative axial movement is produced during makeup of the tool string by rotating a sleeve threadably mounted on the exterior of the pin and engagable to produce axial movement. The sleeve has an external diameter less than the box to prevent frictional engagement of the sleeve with the bore wall of the curved bore portion of the well.

1 Claim, 3 Drawing Sheets

HORIZONTAL DRILLING OR COMPLETION METHOD

This application is a continuation-in-part application of U.S. Pat. application Ser. No. 407,950, filed Sept. 15, 1989, now abandoned, and entitled "Horizontal Drilling or Completion Apparatus" and assigned to the same assignee as the present application.

FIELD OF THE INVENTION

The invention relates to a tubular conduit connection which is activatable within a substantially horizontal section of a vertically positioned subterranean well.

DESCRIPTION OF THE PRIOR ART

During the drilling of a well, sections of drill pipe are connected with rotary members commonly called "tool joints". Such joints consist of an externally threaded tubular member called a "pin" and an internally threaded tubular member called a "box". Subsequent to the drilling of a subterranean oil or gas well, a string of tubular conduit commonly referred to as "casing" is run into the well. Thereafter, the casing is cemented into place. After the cementing operation, it is necessary to perforate the well so the production fluids within the production zone may flow from the production zone, through holes perforated through the cement behind the casing, into holes in the casing, and through the well bore to the top of the well.

For many years the desirability of utilizing a subterranean well bore having a non-vertical or horizontal portion traversing a production formation has been known and appreciated in the art. Laterally directed bores are dilled radially, usually horizontally from the primary vertical well bore, in order to increase contact with the production formation.

Most production formations have a substantial horizontal portion and, when conventional vertical well bores are employed to tap such production formations, a large number of vertical bores must be employed. With the drilling of a well bore having a non-vertical or horizontal portion traversing the production formation, a much greater area of the production formation may be traversed by the well bore and the total drillings costs in the field may be substantially decreased. Additionally, after a particular horizontal well bore has produced all of the economically available hydrocarbons, the same vertical well bore may be re-drilled to establish another horizontal portion extending in another direction and thus prolong the utility of the vertical portion of the well and increase the productivity of the well to include the total production formation.

By use of and reference to the phrase "subterranean well", it is intended to include both cased and uncased wells, both during drilling operations and during completion operations. When uncased wells are drilled or completed, the bore hole wall defines the maximum bore hole diameter at a given location. When cased wells are completed, the "wall" of the well will be the internal diameter of the casing conduit.

By use of the phrase "deviated well" and "deviated well bore", it is meant to refer to wells and well bores which comprise a vertical entry section communicating through a relatively short radius curvature portion with a non-vertical or horizontal portion communicating with the production formation. In most instances, the production formation extends for a substantial horizontal extent and the generally linear well bore portion traverses a substantial horizontal extent of the production formation, at least up to a distance of 1000 to 2000 feet, or more. The radius portion of the well bore has a curvature of at least 10° per 100 feet of length, and preferably a curvature lying in the range of 10° to 30° per 100 feet of length.

In U.S. Pat. No. 3,762,745, entitled "CONNECTION MEMBERS WITH HIGH TORQUE CARRYING CAPACITY" there is shown and disclosed a unique tubular connection. That connection is similar to the connection of the present invention in that it provides for telescopic movement in a selected amount in combination with rotational movement in both clockwise and counterclockwise positions. However, that connection has been found to be not completely satisfactory for use in horizontal drilling and completion operations in that the relative configuration of the splined area to the threaded area makes the connection difficult during make-up. Additionally, the diameter of the sleeve over the threads has been found to cause wear on the sleeve if used in horizontal applications. Accordingly, it has been found that a modified connection as described and claimed herein will improve the performance of the connection means of the prior art and render itself uniquely adaptable for use in horizontal drilling and completion operations, as disclosed and claimed herein. The rotatable make-up means has an outer diameter smaller than that of one of the pin and box members.

By providing a smaller diameter locking sleeve for use in a tool joint for a horizontally deviated well, accidental movement of the locking sleeve to an unlocking position due to frictional engagement of the locking sleeve with the well bore accompanied by rotation of the tubing string required to pass the tool string through the curved portion of the well bore can be eliminated.

The present invention addresses the problems set forth above and provides a method for utilizing a unique tool joint in a subterranean well.

DESCRIPTION OF THE PREFERRED EMBODIMENTS

Figure 1:
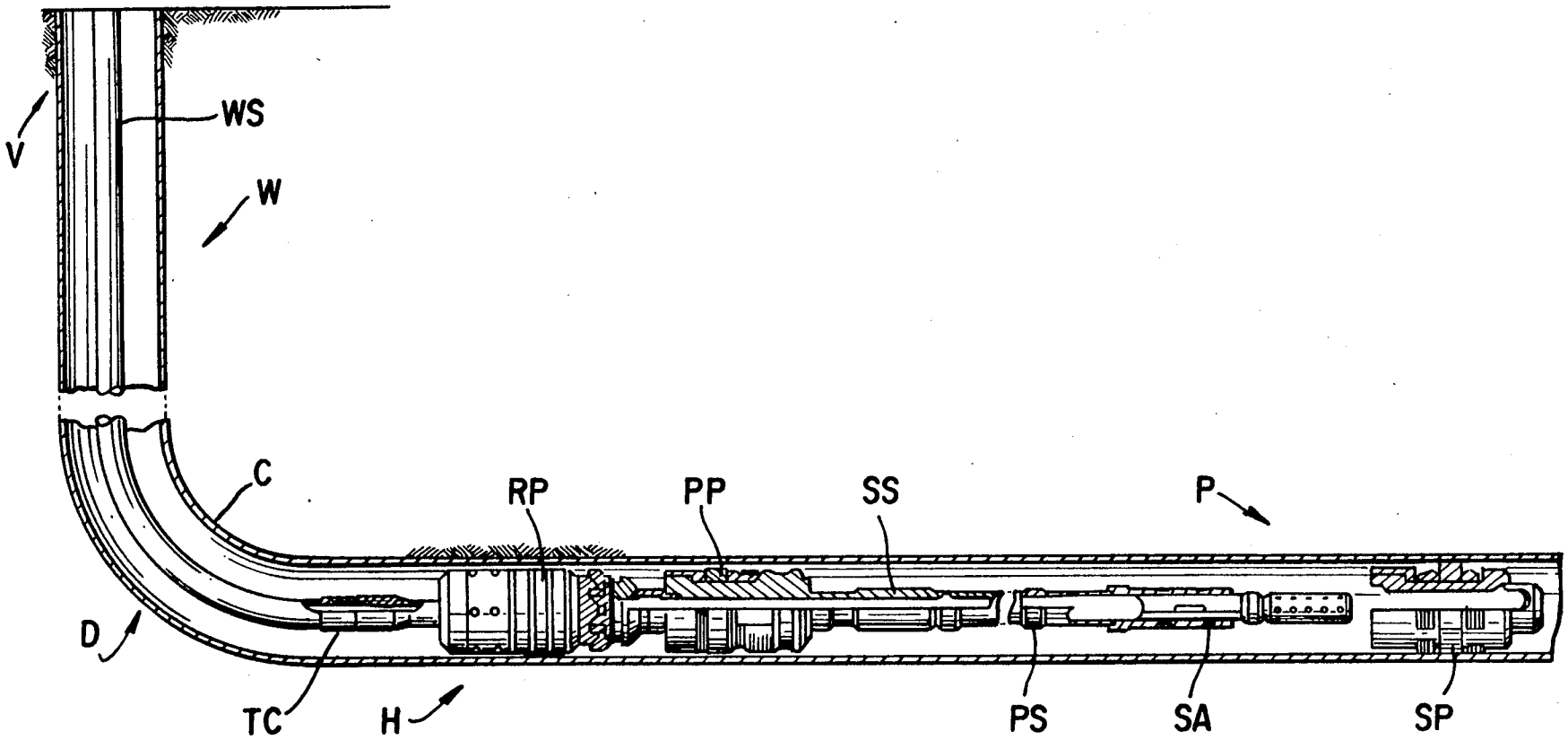
FIG. 1 is a schematic illustration of a subterranean well incorporating the apparatus of the present invention on a workstring in a horizontal section of a deviated well.

With reference to FIG. 1, there is shown a subterranean well W having a first vertical section V communicating with the top of the well and extending into a deviation or curvature D which, in turn, extends into a horizontal section H traversing a production zone P. As shown in FIG. 1, the subterranean well W has been drilled and is in a stage of completion, although it will be appreciated that the horizontal well connection TC of the present invention may be equally adapted for use in horizontal drilling operations.

Prior to running the workstring WS carrying a retrievable packer or P in a permanent packer PP, the casing C has ben placed into the well and connected therein. The casing C will have perforations therethrough subsequent to the firing of a perforating gun 21. The tubular connection TC is shown disposed on the workstring WS ahead of the retrievable packer or P. A conventional sliding sleeve SS is disposed on the exterior of a production string section PS which, in turn, is immediately above a seal assembly SA which is stabbed into a sump packer SP subsequent to retrieval of the perforating gun into the seal assembly housing and is stabbed into the sump packer SP. The operation of the completion concept extending from the retrievable packer RP to the sump packer SP is as disclosed in Ser. No. 345,106, filed Apr. 28, 1989, now U.S. Pat. No. 4,936,387, entitled "HYDRAULICALLY ACTUATED PACKER ASSEMBLY WITH TANDEM PISTON AND CYLINDER ARRANGEMENT".

The connection TC has the primary components that inlcude a threaded box A and a threaded pin B. These members have solid threads on a portion C and slotted or splined threads on a portion D that serve as a locking mens to lock the members together for rotation.

Figure 3:
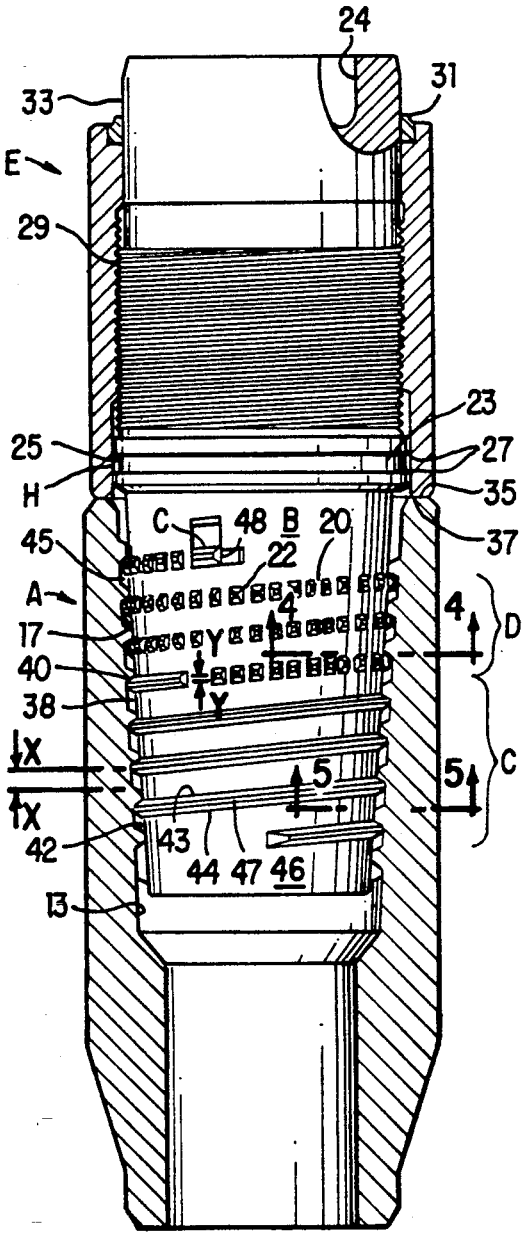
FIG. 3 is a longitudinal view in partial section of the connection members after final stage of connection and engagement of the locking means.
Figure 4:
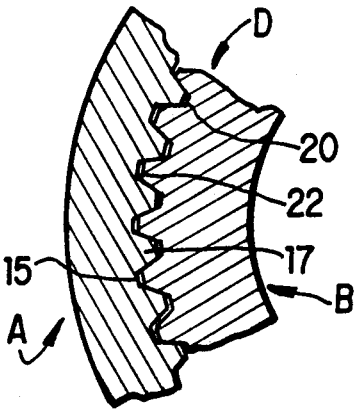
FIGS. 4 and 5 are fragmentary cross-sectional views as seen looking respectively along lines 4—4 and 5—5 of FIG. 3.
Figure 5:
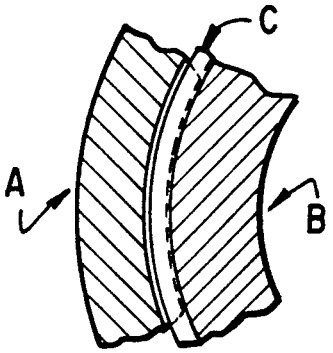
Figure 6:
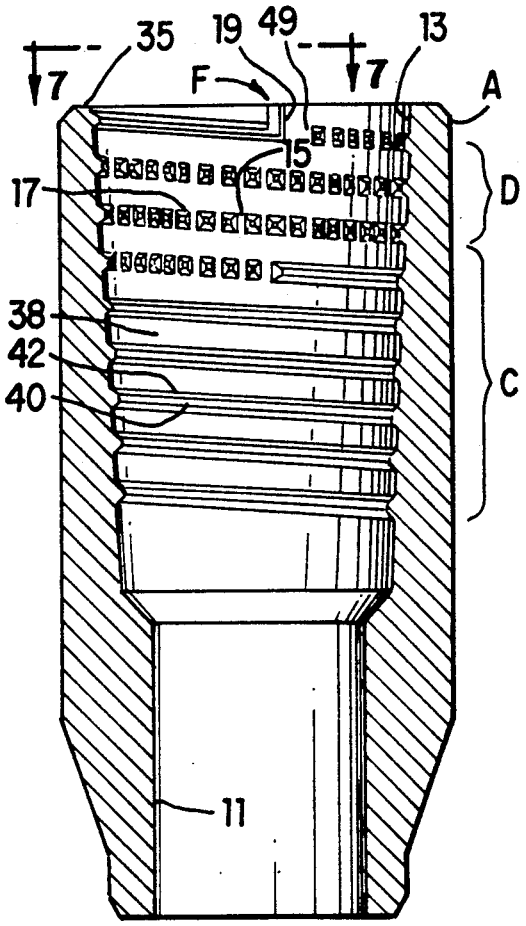
FIG. 6 is a view and longitudinal section of the box member showing an unslotted portion of the threads and a slotted or splined portion of the threads that function as locking means.
Figure 7:
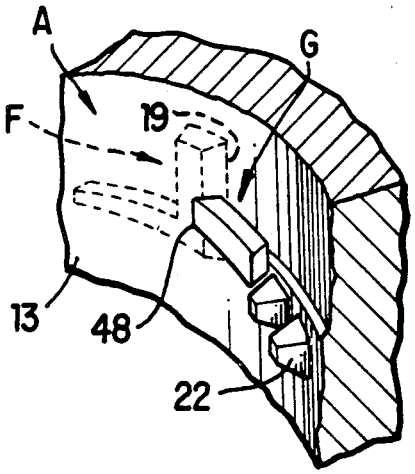
FIG. 7 is a fragmentary perspective view showing the engagement of the stop means with the leading face of the splined thread of the pin member, which together form the alignment means.

The opposed flanks of threads of portion C are spaced axially to permit a selected amount of telescopic movement between the threads and when telescoped to the selected position shown in FIG. 3 the slotted portions D of the threads on the box and pin become mutually mated and locked. A make-up means E is used to hold the slotted portions D of the threads together. To insure proper radial alignment of the splined portions D in preparation for their axial interengagement, a stop means F as shown in FIGS. 6 and 7, engages the leading face of tooth G of the splined portion of the threads on the pin. Further, seal means H are provided between the sleeve and pin and fluid transmitting connections to prevent fluid flow along the threads' surfaces.

Referring now to FIG. 6, the box A is generally tubular and normally positioned to face upward as shown prior to connection with the pin member. Throughout the specification, the terms upward and downward will be used to indicate directions when the connections are positioned and made up at the top of the well as shown in FIG. 1. The interior of the box includes an axial bore 11 and a tapered surface 13 from which protrude the thread portion C and D, the latter being slotted to form splineways 15 and splines or teeth 17. The stop means F has a longitudinally extending face 19.

Figure 2:
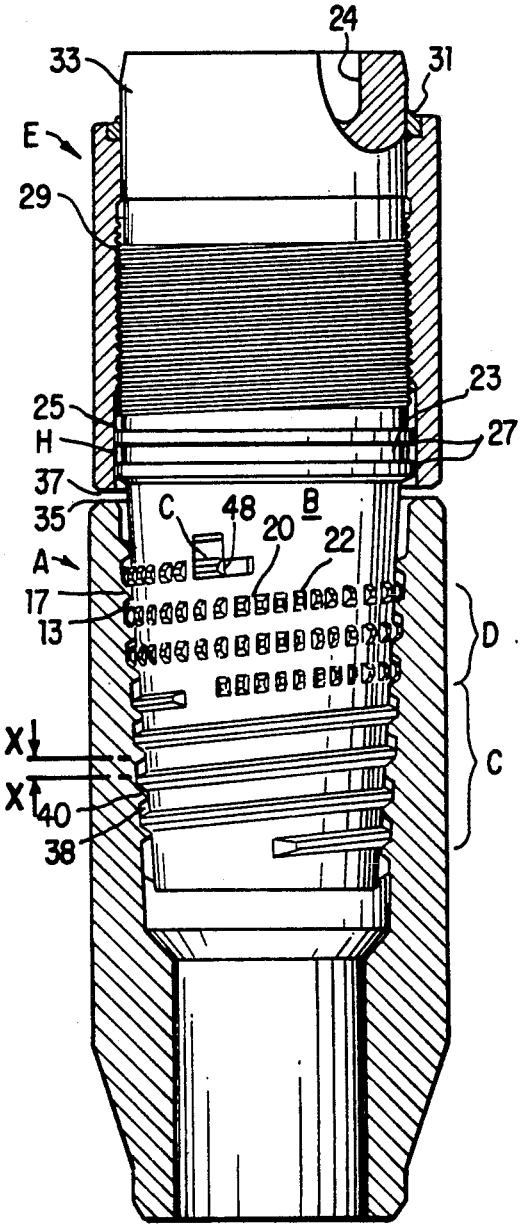
FIG. 2 is a longitudinal view and partial section of the connection members of the present invention shown during their initial stage of connection before engagement of the locking means.

With reference to FIG. 2, the pin B is also generally tubular with the solid thread portion C and a slotted portion D with slots or splineways 20 that form teeth 22. Also, the pin has an axial bore 24 as shown in FIG. 3. The exterior of the pin has a circumferential groove 23 to receive an O-ring 25 and back up rings 27, which are satisfactory components of a seal means H. Above the seal ring 25 is a region of the pin having threads 29 to receive engaging threads of the make-up means E which, in this instance, is in the form of a tubular sleeve having a wiper ring 31 engaging a cylindrical surface 33 above the threads 29. The box A terminates in a radially extending shoulder 35, which is adapted to oppose and engage a radially extending shoulder 37 of the make-up means E. The thread portions C and D of the box form a continuous helix and have the same lead. The grooves 38 of the box are wider than the threads 40. The lower flank 44 of the solid threaded portion C of the pin rides on the upper flank 42 of the box during make-up shown in FIG. 2. Further, the solid threaded portion C of the pin has the same lead as the box and grooves 46 that are wider than the threads 47. The groove width of the solid portion C permits telescopic movement a selected distance X of the pin B relative to the box A. The slotted or splined threaded portion D of the pin mates and locks with the slotted and threaded portion D of the box when telescoped the selected distance X due to the offset Y between the slotted portion D and solid portion C of the threads on the pin B.

For radial alignment of the splined teeth 17 of the box A with the slots 20 of the pin the leading face 48 of leading tooth G engages the face 19 of the stop means F. Two or more teeth G may connect for added strength, as shown. If so, a corresponding gap 49 as shown in FIG. 6 is formed in the teeth of the box by removing one or more teeth.

In operation, in referring initially to FIG. 1, the workstring WS with the connection TC thereon and the components shown in FIG. 1 is moved into the well until the components are within the horizontal section of the subterranean well. The pin is lowered and rotated either clockwise or counterclockwise as seen from above for the threads shown until the leading face 48 of the tooth G engages the face 19 of the stop means F of the box, as indicated in FIG. 7. Then the make-up means, here sleeve E is made up such that shoulder 37 engages the shoulder 35 of the box. It will be appreciated that the make-up means sleeve E has an outer diameter which is smaller than that of the box member A, to avoid wear on the sleeve E during horizontal drilling or completion operations, such that the wear will be directed to and taken by the box member A as opposed to the sleeve member E. Additional rotation of the make-up means E causes the threaded portion C and D of the pin to telescope a distance X to the position shown in FIG. 3. Alternatively, the pin may be moved the distance X relative to the box by externally applied force. In this position the upper flanks 43 of the pin engage the downwardly facing flanks 45 of the box with a force determined by the amount of torque applied between the make-up means E and the box A.

The method of the present invention is applicable to a subterranean well with a generally verticle entry portion which communicates with the generally horizontal production portion having a curved bore section. The method maintains the threaded joints of the tool string in assembly and prevents jamming of the joint threads during rotation of the tool string which is required to move the tool string through the curved bore section. The steps include:

(1) Forming each thread joint that may be frictionally engaged with the walls of the curved bore section by an externally threaded pin element cooperating with an internally threaded box element, the external diameter of said box elements substantially exceeding the external diameter of the pin element;

(2) Configuring the cooperating threads of the pin and bore elements so that limited relative axial movement of the pin and box elements after the cooperating threads are fully engaged produces a locking of the cooperating threads against relative rotation; and (3) Producing relative axial movement during makeup of the tool string by rotating a sleeve threadably mounted on the exterior of the pin element and engagable with the box element to produce limited relative axial movement, the sleeve having an external diameter less than the box element to prevent frictional engagement of the sleeve with the bore wall of the curved bore section.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a subterranean well having a generally vertical entry portion communicating with the generally horizontal production portion and a curved bore section, the method of maintaining threaded joints of a tool string in assembly and preventing jamming of the joint threads by the rotation of the tool string required to move the tool string through the curved bore section, comprising the steps of:

(1) forming each thread joint that may be frictionally engaged with the walls of the curved bore section by an externally threaded pin element cooperating with an internally threaded box element, the external diameter of the box element substantially exceeding the external diameter of the pin element;

(2) configuring the cooperating threads of the pin and box elements so that limited relative axial movement of the pin and box elements after the cooperating threads are fully engaged produces a locking of the cooperating threads against relative rotation; and (3) producing said relative axial movement during makeup of the tool string by rotating a sleeve threadably mounted on the exterior of the pin element and engagable with the box element to produce the limited relative axial movement, the sleeve having an external diameter less than the box element to prevent frictional engagement of the sleeve with the bore wall of the curved bore section.

* * * * *